United States Patent [19]

Davis, Jr.

[11] 4,184,616

[45] Jan. 22, 1980

[54] WIRE COAT HANGER ATTACHMENT

[76] Inventor: George B. Davis, Jr., 7512 Marbury Rd., Bethesda, Md. 20034

[21] Appl. No.: 865,941

[22] Filed: Dec. 30, 1977

Related U.S. Application Data

[63] Continuation-in-part of Ser. No. 756,684, Jan. 4, 1977, Pat. No. 4,066,193.

[51] Int. Cl.[2] ..... A47J 51/086

[52] U.S. Cl. ..... 223/98

[58] Field of Search ..... 233/85, 88, 92, 91, 233/98

[56] References Cited

U.S. PATENT DOCUMENTS

| | | | |
|---|---|---|---|
| 1,722,609 | 7/1929 | Unkefer | 223/88 |
| 2,106,947 | 2/1938 | Hamilton et al. | 223/88 |
| 2,123,369 | 7/1938 | Luecke | 223/88 |
| 2,597,509 | 5/1952 | Mallory | 223/88 |
| 2,601,442 | 6/1952 | Mallory | 223/88 |
| 3,860,153 | 1/1975 | Davis | 223/88 |

*Primary Examiner*—George H. Krizmanich

[57] ABSTRACT

This invention relates generally to garment hangers and particularly to a shoulder and trouser support attachment for use with coat hangers of the conventional bent wire type and that is intended as a throw away device along with the wire hanger after the garments have been removed therefrom.

8 Claims, 4 Drawing Figures

FIG. 1
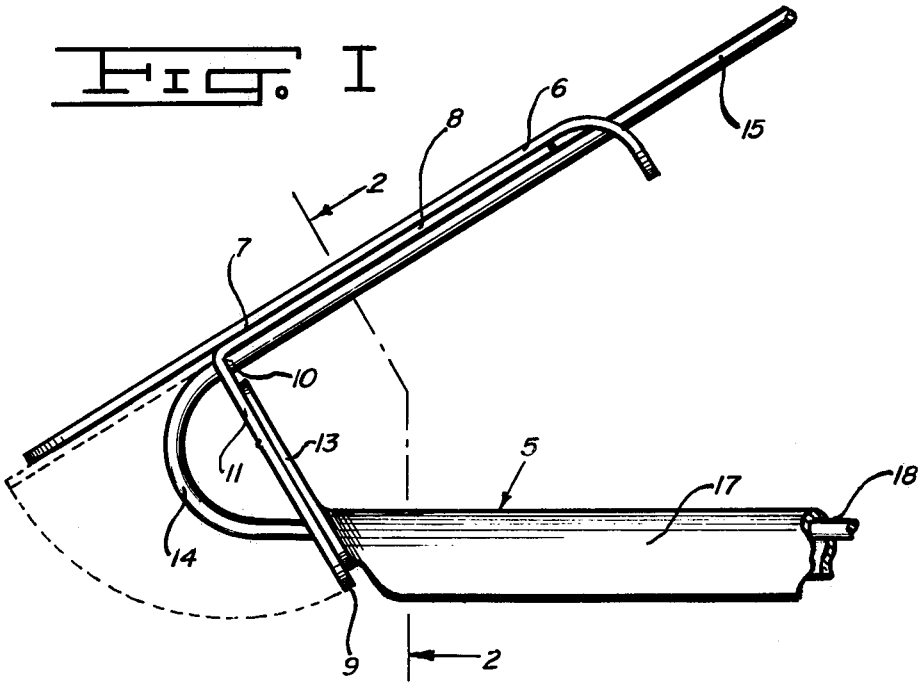
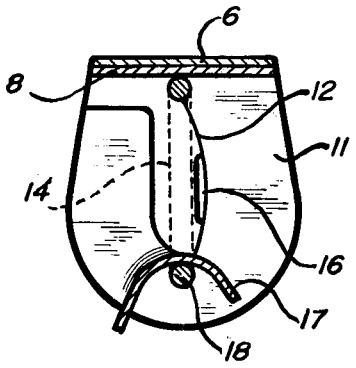
FIG. 2
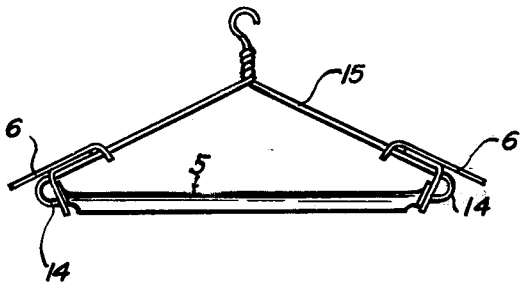
FIG. 4
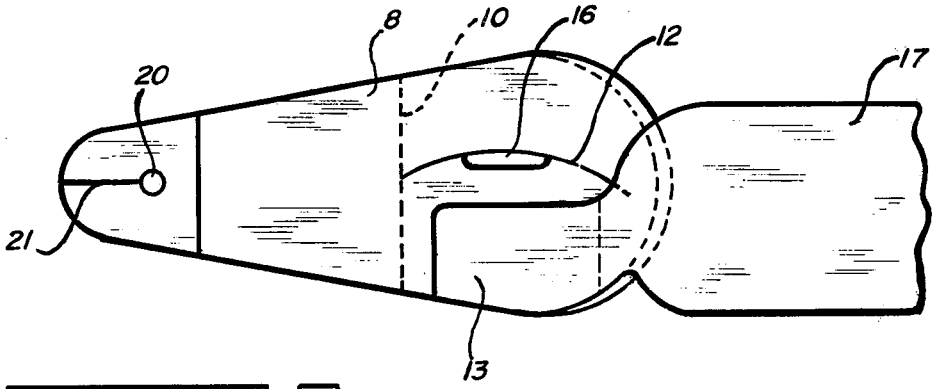
FIG. 3

WIRE COAT HANGER ATTACHMENT

This is a continuation in part of application No. 756,684, filed Jan. 4, 1977, now issued U.S. Pat. No. 4,066,193.

Numerous garment supporting devices of this general type have been previously devised and many of which have served a useful purpose in preventing unsightly bulges forming upon the shoulders of a garment suspended from a hanger that offered too little surface support to the shoulder material for the weight of the garment suspended thereon. This is particularly true in the case of garments returned from the cleaners upon bent wire hangers where the garment is hung hot and damp from the steam press upon such hangers while the material of the shoulders is still soft and pliable. Bulges formed in this manner upon the shoulders, say of a man's coat, will alter the contour and cut of the coat and permanently disfigure the garment until again cleaned whereupon the damaging operation is repeated.

It is the object of the present invention to provide a cheap, preferably cardboard throw-away shoulder support attachment for a conventional bent wire hanger that may, when needed for a garment such as a man's coat, be sleeved over the curved ends of the hanger to lock therewith to provide a wide shoulder supporting surface for the garment as long as it rests thereon and which may thereafter be thrown away with the hanger.

A still further object is to provide an inexpensive throw-away shoulder and trouser supporting attachment for a conventional bent wire hanger that may be quickly and easily installed as a one piece assembly by the cleaner to lock with the hanger with a single mounting operation without the use of special tools or equipment.

A still further object is to provide the combination of a shoulder and trouser support attachment for use with a conventional wire hanger that in operation provides a wide bearing surface for the garments supported therefrom thusly eliminating the bulge upon the coat and crease upon the trousers generally accompanying the use of bare wire hangers of this type.

In order that this invention may be more readily understood, reference is now made to the accompanying drawing wherein:

FIG. 1 is a side view in elevation of one end of the attachment of the invention as mounted upon the end of a conventional garment hanger of the bent wire type.

FIG. 2 is a view, partly cut-away and as taken along 2—2 of FIG. 1 and showing the cresent cut-through in position securing the attachment in place upon the hanger.

FIG. 3 is a plan view in elevation showing the attachment as assembled and flattened for packaging.

FIG. 4 shows the device as assembled with a conventional wire hanger.

Referring now to the drawings and particularly to FIG. 1 thereof wherein the device 5 of the present invention is shown as comprised of a garment or shoulder supporting plate like number 6 which may be of any suitable configuration, desirably such as shown in FIG. 3. For cheapness, this plate 6 may be formed from any suitable type of cardboard or thin plastic and of a thickness sufficiently pliable as to conform yieldably to the inner contour of a garment supported therefrom.

Partially secured as at 7, FIG. 1 to the underside of plate 6, is a second plate 8 preferably of a similar material to that of plate 6. The free end of plate 8 is so positioned with respect to plate 6 that when this extending end portion 9 thereof is manually depressed downward to break at the break line 10, there is formed thereby a depending flange 11 from plate 6 through which has been previously cut a crescent like slot 12. Through this slot is received, when mounting the attachment upon a hanger, the curved end portions 14 of the hanger as shown to advantage in FIGS. 1, 2 and 4. When the hanger ends are pressed to seating position within the slot 12; the curved portin 12 of the crescent cut-through moves to the position shown to thereby effectively lock behind the curved ends 14 of the hanger to positively secure the attachment to the hanger.

Further, by reason of the curved nature of slot 12, as the hanger ends are forcefully inserted through the slot, the plate 8 is in a manner cammed downward and tightly against the upper surface of the hanger bar 15 and whereby the attachment is more ridgidly secured in place upon the hanger. The optional cut-outs 16, and as respectively shown in FIGS. 3 and 4, may be used to provide suitable guide-like openings adjacent the slot 12 for initially receiving the curved end portion of 14 of the hanger as the attachment is mounted thereon and thereby to facilitate assembly of the attachment with the hanger. These cut-outs will in no way reduce the effectiveness of the locking arrangement as provided by the crescent cut 12.

Secured as by cementing or stapleing to the flange 11 as at 13, is a trouser supporting plate 17 formed desirably as shown in FIG. 3. This structure provides that as the shoulder supporting ends of the attachment are moved, as by folding over the outer curved ends of the hanger to be secured within the slot 12, the plate 17 is caused to move to a resting position over the horizontal cross-member 18 of the hanger and in such a manner as to provide a wide bearing surface for trousers suspended thereover. In addition to providing a wide bearing surface, the strip 17 further serves to effectively tie the shoulder supporting ends of the attachment together and thereby to provide a more rugged overall one-unit assembly as apparent from FIG. 4.

To prevent snagging of a garment with the inner or small end of the plates 6, there is provided adjacent the small end thereof a hold and slot 20 and 21 respectively and which, as the attachment 5 is being mounted upon the hanger, is manually pressed over the sloping wire portion 15 of the hanger to interlock therewith in the manner shown to secure the small end of the plates to the hanger. This arrangement prevents the small ends of the plates bending away from the hanger to tangle with a garment being placed or removed from the hanger.

While herein is shown the plates or supporting members of the attachment as being comprised of two pieces of cardboard or the like, it is understood that these plates may be formed as a one piece fold-over if desired or as a plastic molding. Further, while herein the slot 12 is shown as a crescent cut, it is understood that this slot could be made as a straight cut-through however, it has been found that a crescent cut as herein shown is far superior in gripping the hanger surface by providing a locking action with the hanger that is not possible with a straight made cut.

What I therefore claim and desire to cover by letters patent is:

1. A garment supporting attachment for attaching to a conventional bent wire coat hanger having sloping garment shoulder supporting surfaces connected by curved end portions to a horizontal cross-member said supporting attachment comprising, two shoulder supporting portions each respectively, including a first plate having first and second end with said first end for mounting over and extending beyond the curved end portion of the hanger, means forming a second plate secured to and forming an integral part of said first plate and including a free portion having therein a transverse crease line inwardly of said first end and a portion manually engagable to facilitate the bending of said free portion from said first plate at said crease-line, means forming an elongated slit extending through said free portion for receiving therein the curved end of said hanger with the sides of said slit being operative to frictionally grip the sides of said hanger as the curved end portion of the hanger is forcefully inserted to seated position within said slit to form by said slitted free portion a first securing means for fastening said attachment to said hanger, means forming a second securing means extending from the integral portion of said first plate at second end thereof and manually movable into locking engagement with the sloping garment supporting surface of said hanger and cooperative with said first securing means to maintain respectively affixed each of said shoulder supporting attachments mounted over the curved outer end portions of said hanger, a trouser supporting strip respectively affixed at its ends to the free portion of each of said shoulder supporting members and having a portion movable over the wire cross member of said hanger as the curved hanger ends are respectively received in said slits during mounting of said attachment to a hanger and with said strip and said first and second securing means, when free of said hanger, being movable to a substantially flat assembly for stacking one upon the other for advantageous packaging shipping and handling.

2. A garment supporting attachment for a wire hanger as called for in claim 1 wherein the slit in said free portion is in the configuration of a crescent cut-through.

3. A garment supporting attachment for a wire hanger as called for in claim 1 wherein said slit includes an enlarged guide opening space significantly inwardly from the ends of the slit.

4. A garment supporting attachment for a wire coat hanger as called for in claim 1 wherein said free portion includes a portion movable behind the curved end of the hanger after the latter is inserted through the slit in said free portion.

5. A garment supporting attachment for a wire coat hanger as called for in claim 1 wherein only the side of one end of said strip is affixed to said free portion and with said strip including a free side for extending over said cross member of said hanger as the attachment is mounted upon said hanger.

6. A garment supporting attachment for a wire garment hanger as called for in claim 1 wherein said means for locking behind the sloping shoulder supporting surfaces of said hanger is in the form of a hole and intersecting slit and moveable out of the plane of said plate to lock behind the sloping wire should supporting surfaces of said hanger.

7. A garment supporting attachment for a wire coat hanger as called for in claim 1 wherein said plate, flange and strip are compressable into a substantially flat assembly for stacking and packaging.

8. A garment supporting attachment as called for in claim 1 wherein said trouser supporting strip is formed as an integral portion of said free portion of said shoulder supporting portions of said attachment.

* * * * *